US011324343B2

(12) United States Patent
Okerstrom et al.

(10) Patent No.: US 11,324,343 B2
(45) Date of Patent: May 10, 2022

(54) MODULAR PANEL MOUNT STRIP

(71) Applicant: North Star Surfaces, LLC, St. Paul, MN (US)

(72) Inventors: Clinton Okerstrom, St. Paul, MN (US); Patrick Bluhm, St. Paul, MN (US); David Schutz, St. Paul, MN (US)

(73) Assignee: North Star Surfaces, LLC, Saint Paul, MN (US)

( * ) Notice: Subject to any disclaimer, the term of this patent is extended or adjusted under 35 U.S.C. 154(b) by 189 days.

(21) Appl. No.: 16/557,607

(22) Filed: Aug. 30, 2019

(65) Prior Publication Data

US 2021/0059439 A1 Mar. 4, 2021

(51) Int. Cl.
*A47G 1/17* (2006.01)
*A47G 1/16* (2006.01)

(52) U.S. Cl.
CPC ..... *A47G 1/17* (2013.01); *A47G 1/1686* (2013.01)

(58) Field of Classification Search
CPC ..... A47G 1/1686; A47G 1/1606; A47G 1/17; A47G 2001/0672; H01F 7/0221; F16M 13/02; F16M 13/022; F16M 11/041; F16B 5/0016; F16B 5/0664; F16B 5/008; F16B 5/0084; F16B 2001/0035
USPC ..... 248/467, 206.5
See application file for complete search history.

(56) References Cited

U.S. PATENT DOCUMENTS

| | | | | | |
|---|---|---|---|---|---|
| 1,908,200 | A * | 5/1933 | Chilion | A47G 1/1686 | 248/495 |
| 2,414,653 | A * | 1/1947 | Lookholder | A47K 1/09 | 335/285 |
| 3,239,178 | A | 3/1966 | Pompa | | |
| 3,827,021 | A * | 7/1974 | Phelon | A47J 47/16 | 335/285 |
| 4,744,189 | A | 5/1988 | Wilson | | |
| 4,875,654 | A | 10/1989 | Chandonnet et al. | | |
| 5,384,999 | A | 1/1995 | Roche et al. | | |
| 5,916,102 | A | 6/1999 | Peyton | | |
| 5,921,516 | A * | 7/1999 | Ho | F16M 13/02 | 248/206.5 |

(Continued)

FOREIGN PATENT DOCUMENTS

| | | | |
|---|---|---|---|
| JP | 2004305723 | A | 11/2004 |
| WO | 2013068582 | A2 | 5/2013 |

*Primary Examiner* — Ingrid M Weinhold
(74) *Attorney, Agent, or Firm* — Grumbles Law PLLC; Brittany Nanzig

(57) ABSTRACT

A modular panel mount strip for mounting a panel or piece of art to a wall comprising an elongate body and a magnet. The elongate body includes a magnet housing, a segmentation groove, and at least one interlocking feature. The magnet housing retains the magnet within the elongate body. The segmentation groove is located between a top edge of the elongate body and a bottom edge of the elongate body and can be structured and configured to be broken by human force without breaking other parts of the elongate body. The interlocking feature includes a hinged portion on a first end of the elongate body and/or a locking portion on an opposing end of the elongate body. The locking portion of a first modular panel mount strip can interlock with the hinged portion of a second modular panel mount strip, thereby creating an interlocking mechanism and lengthening the overall device.

19 Claims, 6 Drawing Sheets

(56) References Cited

U.S. PATENT DOCUMENTS 6,719,155 B1 * 4/2004 Chang ..... B25H 3/04 206/350
7,934,330 B2 5/2011 Nicolaisen
7,971,736 B1 * 7/2011 Stewart ..... A47G 21/14 211/70.7
7,997,024 B2 * 8/2011 Gesik ..... A01K 97/06 43/57.1
8,272,506 B1 * 9/2012 Flannery ..... A47G 23/02 206/217
8,397,411 B2 3/2013 Russo et al.
8,434,730 B2 5/2013 Ahlstrom
8,484,873 B2 7/2013 Splittgerber
8,596,600 B2 12/2013 Spencer et al.
9,010,759 B2 * 4/2015 McDonnell ..... A63F 9/00 273/342
9,048,647 B2 6/2015 Myers et al.
9,697,754 B2 7/2017 White
9,709,215 B2 7/2017 Yoo et al.
9,901,196 B2 2/2018 Azorsky et al.
10,010,173 B1 * 7/2018 Ricco ..... A47B 81/00
10,269,271 B2 4/2019 White
10,326,261 B1 7/2019 Kim
2004/0238466 A1 * 12/2004 Shiao ..... B25H 3/04 211/70.6
2005/0223611 A1 * 10/2005 Dennis ..... A47G 1/1613 40/729
2008/0187393 A1 * 8/2008 Nellessen ..... A63H 3/50 403/345
2009/0100732 A1 4/2009 Seidler
2011/0042542 A1 * 2/2011 Russo ..... A47G 1/17 248/467
2012/0043348 A1 * 2/2012 Sunatori ..... B65D 51/242 222/142.3
2016/0073796 A1 * 3/2016 Nesbitt ..... A47G 1/065 40/711
2017/0086580 A1 * 3/2017 Conti ..... B65D 51/242
2017/0138378 A1 * 5/2017 Davidson ..... A47G 33/004
2017/0203607 A1 7/2017 Holmes et al.
2017/0231388 A1 8/2017 Will et al.
2020/0316485 A1 * 10/2020 Haughey ..... A63H 33/26

* cited by examiner

MODULAR PANEL MOUNT STRIP

FIELD OF THE INVENTION

This disclosure relates to modular panel mount strips, and more particularly, relates to modular panel mount strips having a magnet component.

BACKGROUND OF THE INVENTION

Decorative panels, writable surface panels, acoustic panels, and other art is often hung or otherwise placed on walls for aesthetic and functional purposes. Installation of these panels has previously been by the use of traditional wall-mounting means such as screws, bolts, nails, etc. However, these mounting means tend to be spaced on a wall to specifically accommodate the item being mounted, can cause damage to the item, and require maintenance to the wall once the item, and thereby the mounting means, are removed. Further, alternative mounting means known in the art, such as those described in U.S. Pat. Nos. 4,875,654; 8,397,411; 9,709,215; and 10,326,261 are fixed in size and must fit behind the panel in those provided sizes. Therefore, a wall-mounting device is needed that does not cause damage to an item that is to be placed on a wall and that can vary in size to accommodate various sizes of wall-mounted items.

SUMMARY OF THE INVENTION

This disclosure relates to modular panel mount strips, and more particularly, relates to modular panel mount strips having a magnet component. In an illustrative but non-limiting example, the modular panel mount strip may be comprised of an elongate body having a front face, a back face, a top edge, a bottom edge, and a magnet housing; a magnet retained within the magnet housing; a segmentation groove located between the top edge and the bottom edge of the elongate body; and an interlocking feature located on an end of the modular panel mount strip that is structured and configured to interlock with a second interlocking feature on an end of a second modular panel mount strip.

In some cases, the modular panel mount strip further comprises a second segmentation groove between the top edge and the bottom edge of the elongate body. Further the segmentation groove and the second segmentation groove may be located on either side of the magnet housing and may be elongate channels on the back face of the elongate body.

In some cases, the modular panel mount strip further comprises a second magnet housing. Further, the modular panel mount strip may include a second magnet, which may be retained within the second magnet housing.

In some cases, the magnet housing may be comprised of an aperture defined by an annular, sloped housing wall, as well as at least two retention tabs on opposing ends of the housing wall. The magnet may be annular in shape, may have sloped sides that correspond to the annular, sloped housing wall of the magnet housing, and may be retained within the magnet housing by the at least two retention tabs.

In some cases, the interlocking feature may be comprised of a hinged portion located on the end of the modular panel mount strip, and the second interlocking feature may be comprised of a locking portion located on the end of the second modular panel mount strip. Further, the hinged portion on the modular panel mount strip may be comprised of a hinge along an outer edge, as well as an interior slot. The locking portion on the second modular panel mount strip may be comprised of a plurality of hinge tabs for accepting the hinge, as well as a slot tab for acceptance by the interior slot. The modular panel mount strip may further include a second segmentation groove between the top edge and the bottom edge of the elongate body, wherein the segmentation groove may be located between the magnet housing and the hinged portion, and the second segmentation groove may be located between the magnet housing and an opposing end of the modular panel mount strip.

In some cases, the interlocking feature may be comprised of a locking portion located on the end of the modular panel mount strip, and the second interlocking feature may be comprised of a hinged portion located on the end of the second modular panel mount strip. Further, the hinged portion on the second modular panel mount strip may be comprised of a hinge along an outer edge, as well as an interior slot. The locking portion on the modular panel mount strip may be comprised of a plurality of hinge tabs for accepting the hinge, as well as a slot tab for acceptance by the interior slot. The modular panel mount strip may further include a second segmentation groove between the top edge and the bottom edge of the elongate body. The segmentation groove may be located between the magnet housing and the locking portion, and the second segmentation groove may be located between the magnet housing and an opposing end of the modular panel mount strip.

In another illustrative but non-limiting example, the modular panel mount strip may be comprised of an elongate body having a front face, a back face, a top edge, a bottom edge, and two magnet housings; at least one magnet retained within either of the two magnet housings; a segmentation groove between the top edge and the bottom edge of the elongate body; and an interlocking mechanism comprising a hinged portion on a first end of the elongate body, as well as a locking portion on a second, opposite end of the elongate body. In some cases, the segmentation groove can be located between one of the first or the second ends of the elongate body and the two magnet housings. In some cases, the segmentation groove is an elongate channel in the back face of the elongate body.

In some cases, the modular panel mount strip further comprises a second segmentation groove between the top edge and the bottom edge of the elongate body. The second segmentation groove may be located between the other of the first or the second ends of the elongate body and the two magnet housings so that the two magnet housings are positioned between the segmentation groove and the second segmentation groove. Each of the two magnet housings may be comprised of an aperture defined by an annular, sloped housing wall, and at least two retention tabs on opposing ends of the housing wall. Further, the magnet may be annular in shape, have sloped sides that correspond to the sloped housing walls of each of the magnet housings, and may be retained within one of the two magnet housings by the at least two retention tabs.

In some cases, the elongate body of the modular panel mount strip may be further comprised of a plurality of mounting points. The mounting points may be through-holes and may be positioned in two rows along a length of the elongate body. A first of the two rows may be along a top portion of the front and back face, and a second of the two rows may be along a bottom portion of the front and back face.

The above summary is not intended to describe each and every example or every implementation of the disclosure. The Description that follows more particularly exemplifies various illustrative embodiments.

BRIEF DESCRIPTION OF THE DRAWINGS

The following description should be read with reference to the drawings. The drawings, which are not necessarily to scale, depict examples and are not intended to limit the scope of the disclosure. The disclosure may be more completely understood in consideration of the following description with respect to various examples in connection with the accompanying drawings, in which.

DETAILED DESCRIPTION

Figure 1:
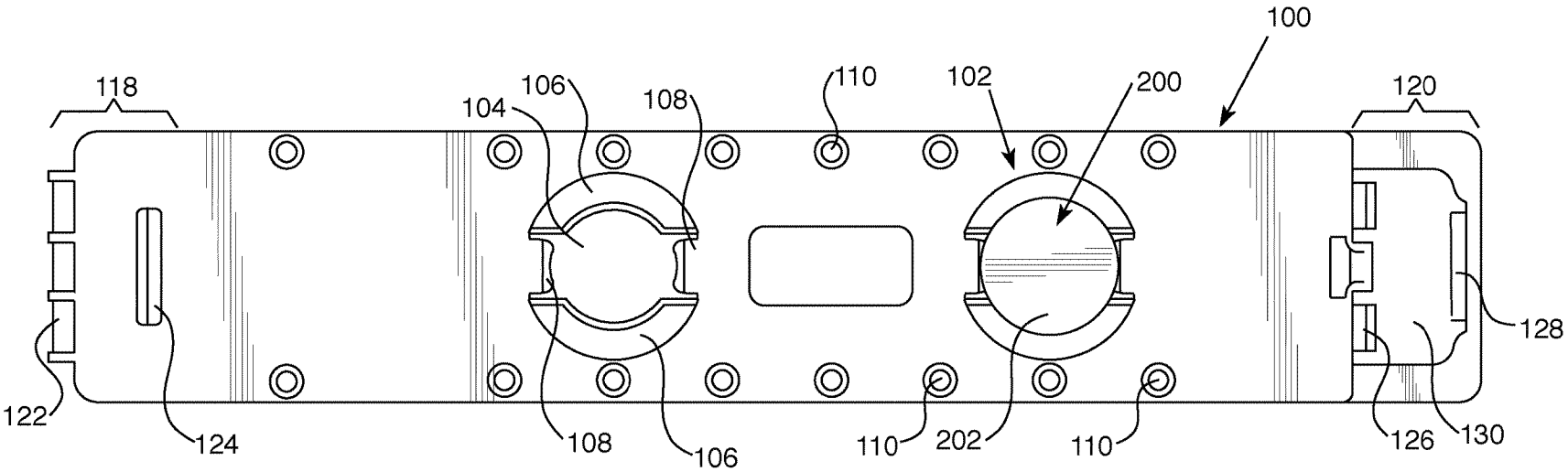
FIG. 1 is a front view of an illustrative example of a modular panel mount strip.
Figure 2:
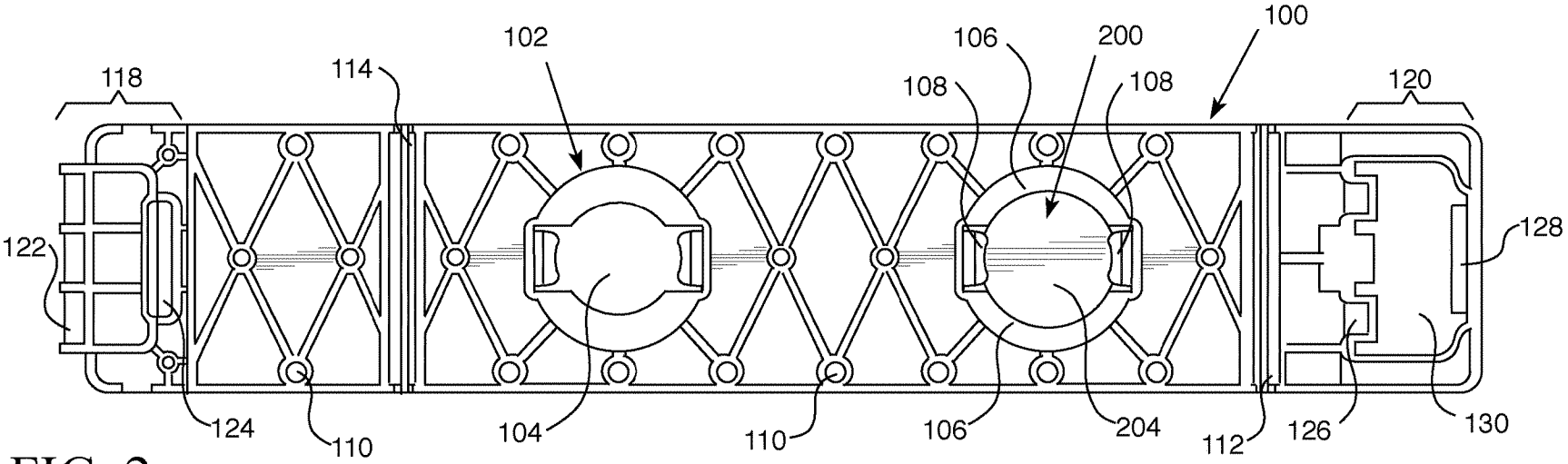
FIG. 2 is a back view of the modular panel mount strip.
Figure 7:
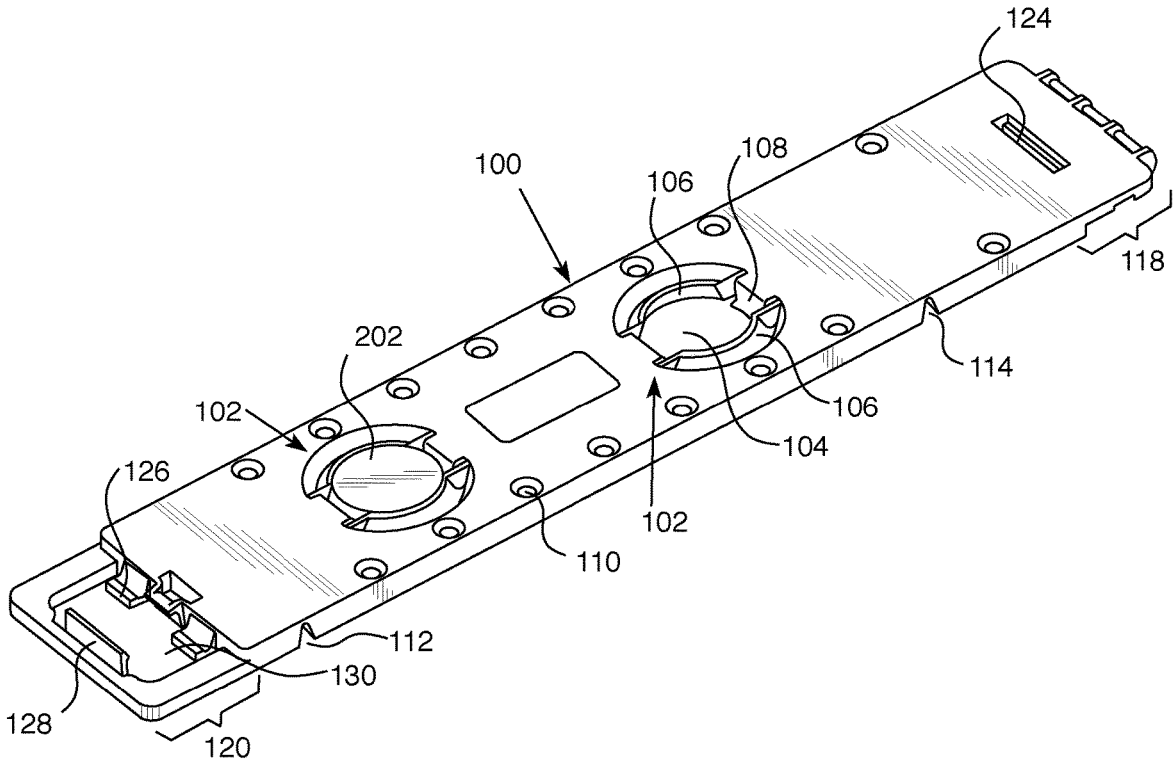
FIG. 7 is an isometric front, top view of the modular panel mount strip.
Figure 8:
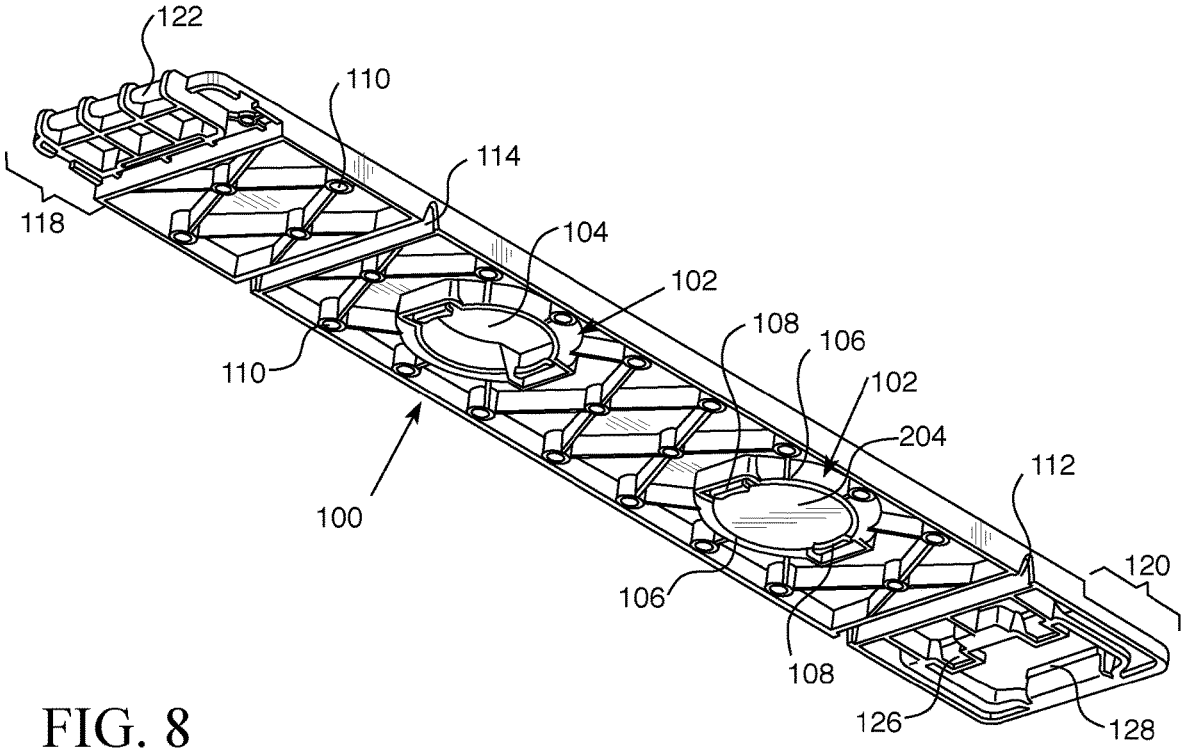
FIG. 8 is an isometric back, bottom view of the modular panel mount strip.
Figure 9:
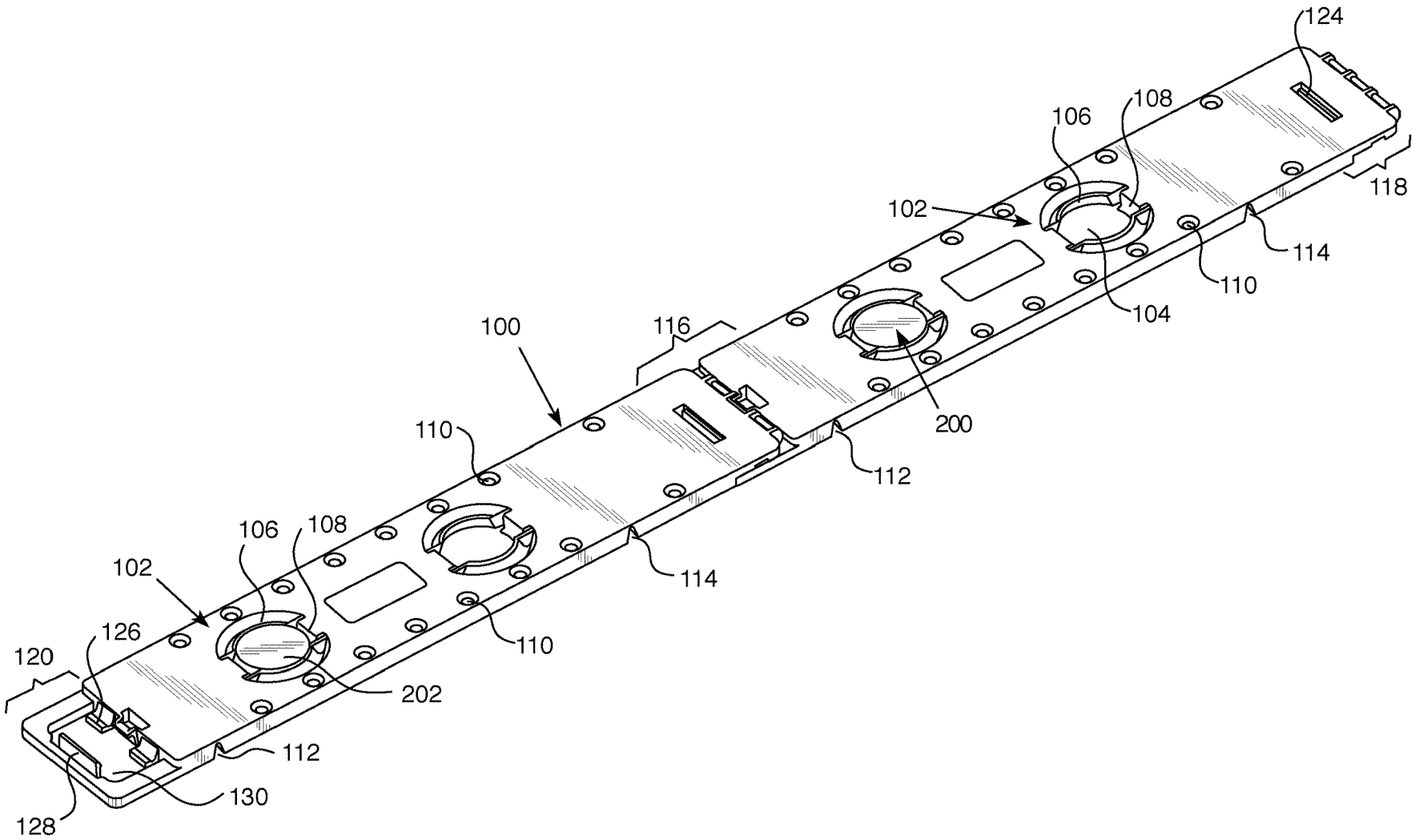
FIG. 9 is an isometric front, top view of the modular panel mount strip interlocked with a second modular panel mount strip.
Figure 10:
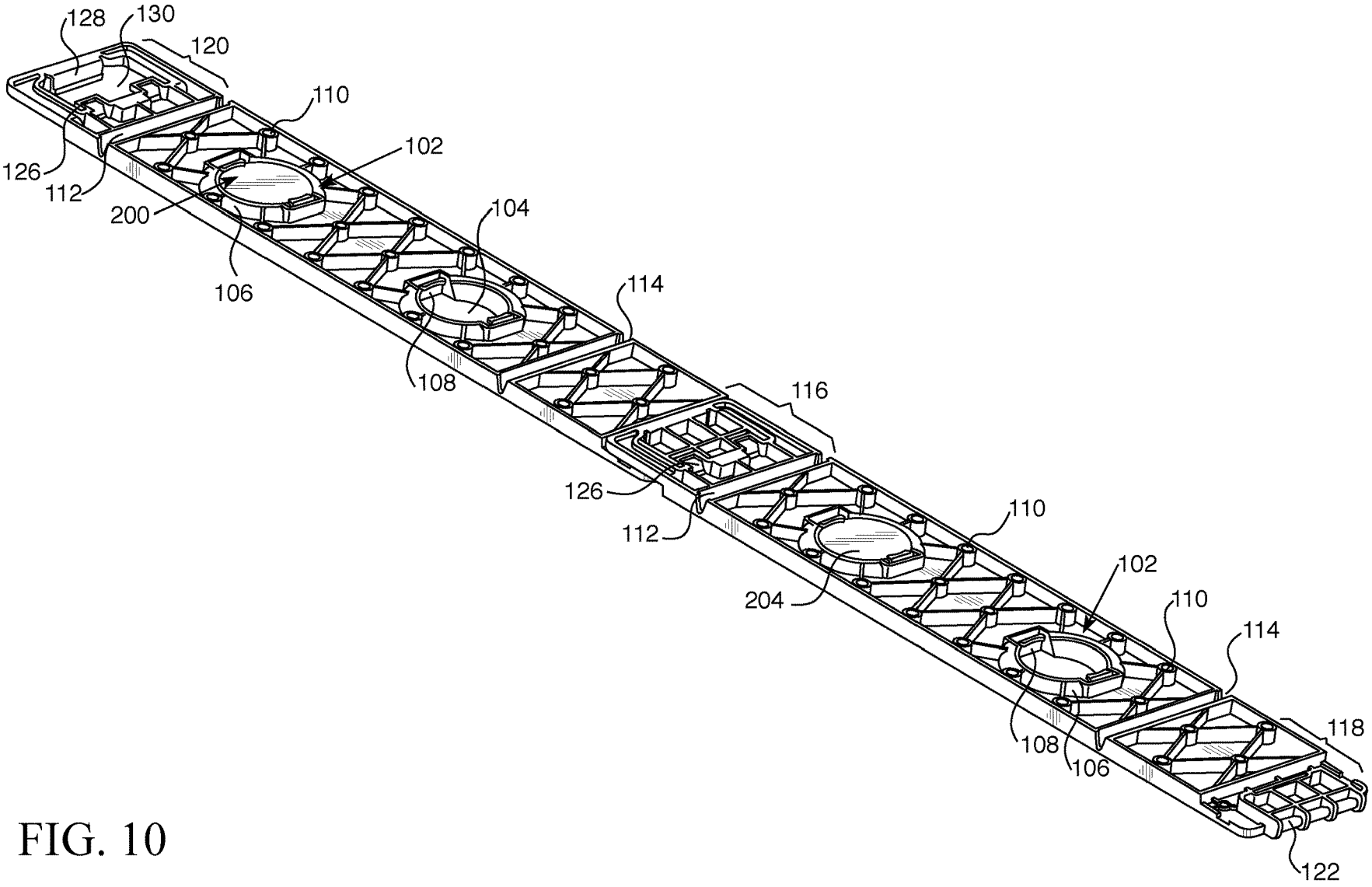
FIG. 10 is an isometric back, bottom view of the modular panel mount strip interlocked with a second modular panel mount strip.

The present disclosure relates to modular panel mount strips, and more particularly, relates to modular panel mount strips having a magnet component. Various embodiments are described in detail with reference to the drawings, in which like reference numerals may be used to represent like parts and assemblies throughout the several views. Reference to various embodiments does not limit the scope of the systems and methods disclosed herein. Examples of construction, dimensions, and materials may be illustrated for the various elements, those skilled in the art will recognize that many of the examples provided have suitable alternatives that may be utilized. Any examples set forth in this specification are not intended to be limiting and merely set forth some of the many possible embodiments for the systems and methods. It is understood that various omissions and substitutions of equivalents are contemplated as circumstances may suggest or render expedient, but these are intended to cover applications or embodiments without departing from the spirit or scope of the disclosure. Also, it is to be understood that the phraseology and terminology used herein are for the purpose of description and should not be regarded as limiting. FIG. 1 is a front view of an illustrative example of a modular panel mount strip. FIG. 2 is a back view of the modular panel mount strip, and FIGS. 3-8 are isometric views of the same. FIGS. 9 and 10 are front and back isometric views illustrating two modular panel mount strips interlocked with each other.

The modular panel mount strip can be comprised of elongate body 100 and magnet 200. Generally, elongate body 100 can be rigid (for example, made of plastic, wood, or metal), although it can also have some flexibility to it as is the case with dense rubbers or flexible plastics, and can include one or more magnet housings, one or more segmentation grooves that enable it to separate into two or more pieces so as to shorten its length, and an interlocking mechanism that enables it to interlock with one or more additional modular panel mount strips. Magnet 200 may be a neodymium magnet and may be sized to fit within the magnet housing.

Elongate body 100 may be relatively long compared to its height. Further, elongate body 100 may be thin in depth so that when it is mounted to a wall and supporting a panel (such as, but not limited to, decorative panels, writable surface panels, acoustic panels, etc.) or other piece of art, it is not visible. In some embodiments, elongate body 100 may include magnet housing 102, mounting points 110, a first segmentation groove (for example, short-end segmentation groove 112), a second segmentation groove (for example, long-end segmentation groove 114), and interlocking mechanism 116. In some cases, elongate body 100 may include two magnet housings 102. Additionally, the interlocking mechanism may include hinged portion 118 and locking portion 120, as illustrated in FIGS. 1-8.

Magnet housing 102 may be centered on a front face of elongate body 100 such that equal amounts of space on the front face remain above and below the front face of the magnet housing (i.e., the space between the top of the front face of the magnet housing and the top of the front face of the elongate body is substantially equivalent to the space between the bottom of the front face of the magnet housing and the bottom of the front face of the elongate body), as illustrated in FIG. 1. However, magnet housing 102 may be shifted up or down thereby leaving unequal amount of space on the front face above and below the magnet housing. As described further herein, magnet housing 102 may be located between short-end segmentation groove 112 and long-end segmentation groove 114 such that removing the ends of elongate body 100 does not result in removal of the magnet housing from the elongate body.

Figure 3:
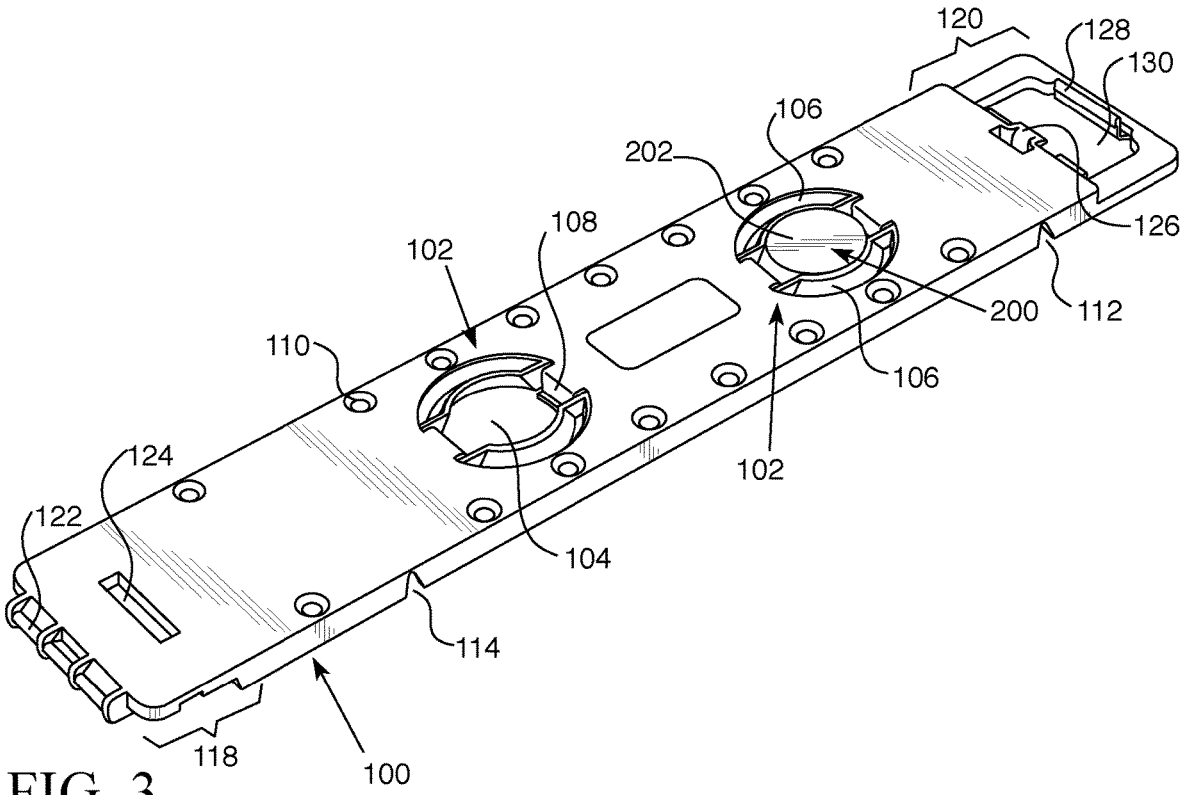
FIG. 3 is an isometric front, bottom view of the modular panel mount strip.
Figure 4:
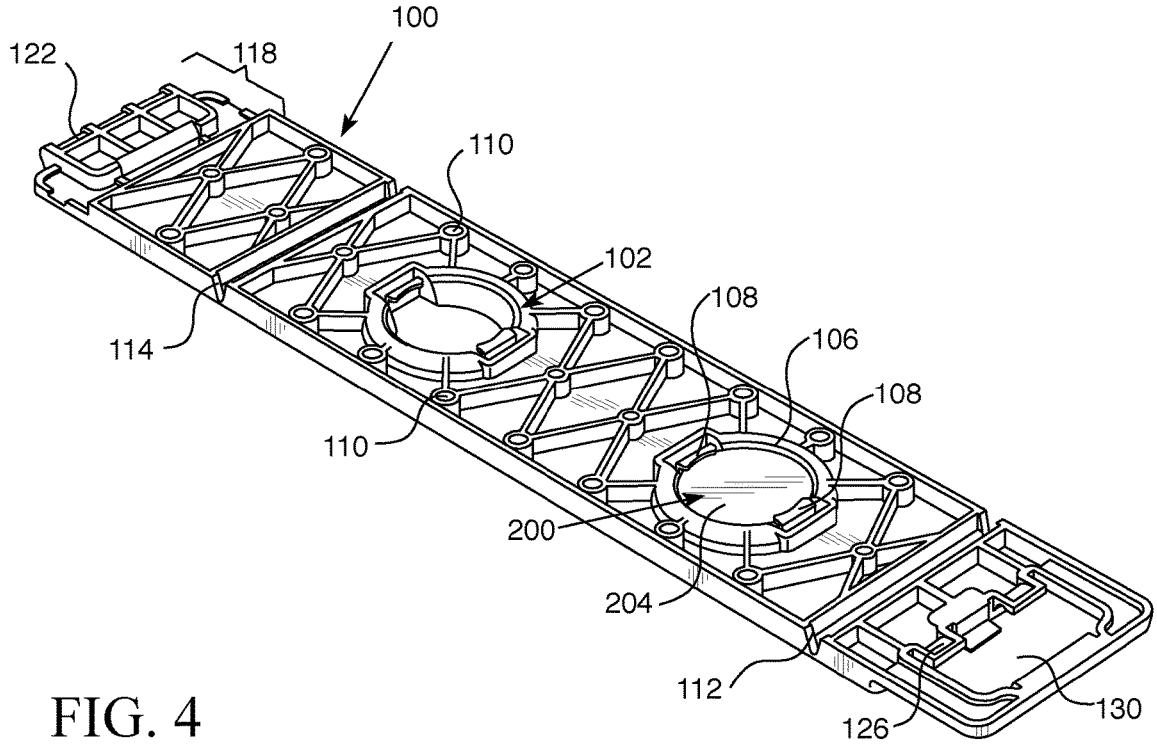
FIG. 4 is an isometric back, top view of the modular panel mount strip.

Magnet housing 102 may be comprised of aperture 104, housing walls 106, and retention tabs 108. Aperture 104 can be a through-hole and may be defined by housing walls 106, which surround it, as illustrated in FIGS. 3-4. Housing walls 106 may be annular, as illustrated in the Figures. Alternatively, the housing walls can be another shape such as, but not limited to, square, rectangular, triangular, etc. In some cases, housing walls 106 may be sloped or angled such that the diameter of the housing walls nearest the back face of elongate body 100 is greater than the diameter of the housing walls nearest the front face of the elongate body, as illustrated in FIGS. 2-3.

In some embodiments, magnet housing 102 may be comprised of two retention tabs 108, as illustrated in FIGS. 2 and 4, although magnet housing 102 can include more than two retention tabs. Retention tabs 108 may be on opposing ends of the housing wall and may be structured and configured to retain magnet 200 within aperture 104 and between housing walls 106 of magnet housing 102. For example, retention tabs 108 may be structured and configured to flex outward away from aperture 104 and toward housing walls 106 when magnet 200 is pushed into the aperture and, once the magnet has passed into the aperture, the retention tabs may snap back into place and create a lip upon which the magnet can rest and/or be held in place. More specifically, retention tabs 108 may include three main components: a first portion that protrudes from the front face of elongate body 100 into aperture 104, a second portion that acts as the lip that protrudes further into the aperture along the same plane as the back face of the elongate body, and a third portion that connects the first and second portions and that can flex when magnet 200 pushes against the second portion as it is being inserted or removed.

In some embodiments, retention tabs 108 may be on the same plane as the back face of elongate body 100, such that the back face of elongate body 100 can be placed flush against a wall. Therefore, magnet 200 may have a shorter height than that of elongate body 100 (wherein height of the elongate body is defined as the distance between the front and back faces of the elongate body) so as to enable it to accommodate the loss of depth taken by retention tabs 108. For example, retention tabs 108 may engage a portion of the magnet back face (204) of magnet 200, as illustrated in FIG. 2, to hold magnet 200 in place. The magnet back face 204 is opposite of the magnet front face 202 of magnet 200, such as illustrated in FIG. 1. However, retention tabs 108 may not be on the same plane as the back face of elongate body and may, instead, be sunken below the plane of the back face of the elongate body (i.e., sunk into aperture 104) or may be raised above the plane of the back face of the elongate body.

As described above, elongate body 100 may also include mounting points 110. Mounting points 110 may be through-holes, as illustrated in FIGS. 7-8. However, they may alternatively be blind holes. In some embodiments, the mounting points may be sized and configured to accept screws and/or nails such that the user can secure the modular panel mount strip to a wall. Once the modular panel mount strip is secured to a wall, a panel, as described above, or other piece of art having a ferromagnetic component on its back face can be aligned with magnet 200 so that it can be mounted indirectly to the wall. In this configuration, therefore, the back face of the modular panel mount strip is in contact with the wall, and the back face of the panel or piece of art in contact with the front face of the modular panel mount strip. After installation is complete, the modular panel mount strip may not be visible to anyone viewing the panel or piece of art due to the thin depth of the modular panel mount strip, as described above.

In some embodiments, the plurality of mounting points may be positioned in one or more rows along a length of elongate body 100, as illustrated in FIGS. 1-2. For example, a row of mounting points 110 may be located along a top portion of the front and back faces of elongate body 100. Alternatively, the row of mounting points may be located along a bottom portion of the front and back faces of elongate body 100. As illustrated in FIGS. 1-2, if there are two rows of mounting points 110, the first row may be along the top portion and the second row may be along the bottom portion of front and back faces. The number of mounting points may be equivalent between the first and second rows or they may vary. For example, the first row may have eight mounting points and the bottom row may also have eight mounting points or may have more or less than eight mounting points. In some embodiments, as described further below, one or more mounting points may be located between an end of elongate body 100 and one of short-end segmentation groove 112 or long-end segmentation groove 114, as illustrated in FIG. 2. Therefore, for example, if the length of elongate body 100 is shortened by severing off the end of the elongate body along long-end segmentation groove 114, the number of mounting points remaining on the elongate body may decrease by one or more.

To vary the length of elongate body 100, modular panel mount strip may include features such as segmentation grooves to shorten its length and an interlocking mechanism to combine two or more modular panel mount strips together and increase the overall length. These features may also be used in combination in order to create a modular panel mount strip that is custom-sized. For example, a user could combine two modular panel mount strips together and then remove a portion of one of the modular panel mount strips by severing the strip along a segmentation groove. Therefore, the final length is greater than the length of one modular panel mount strip, but less than the length of two modular panel mount strips. Other combinations of increasing and decreasing length are envisioned.

Figure 5:
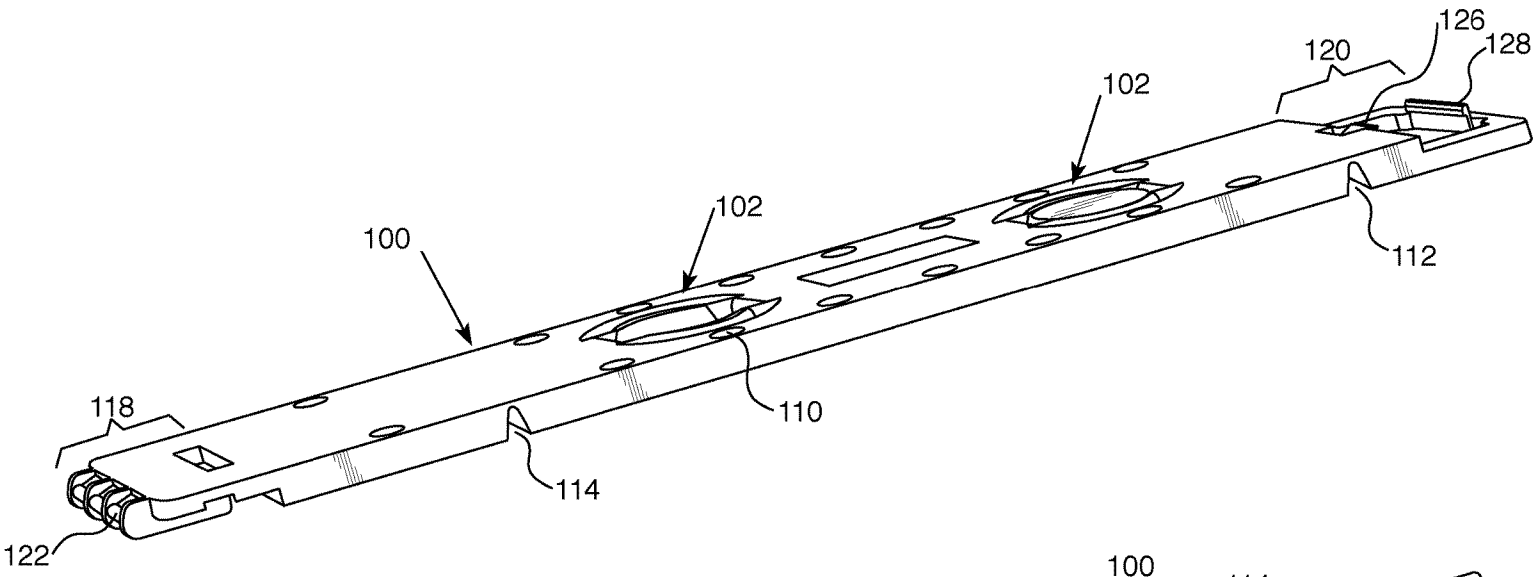
FIG. 5 is an isometric bottom view of the modular panel mount strip.
Figure 6:
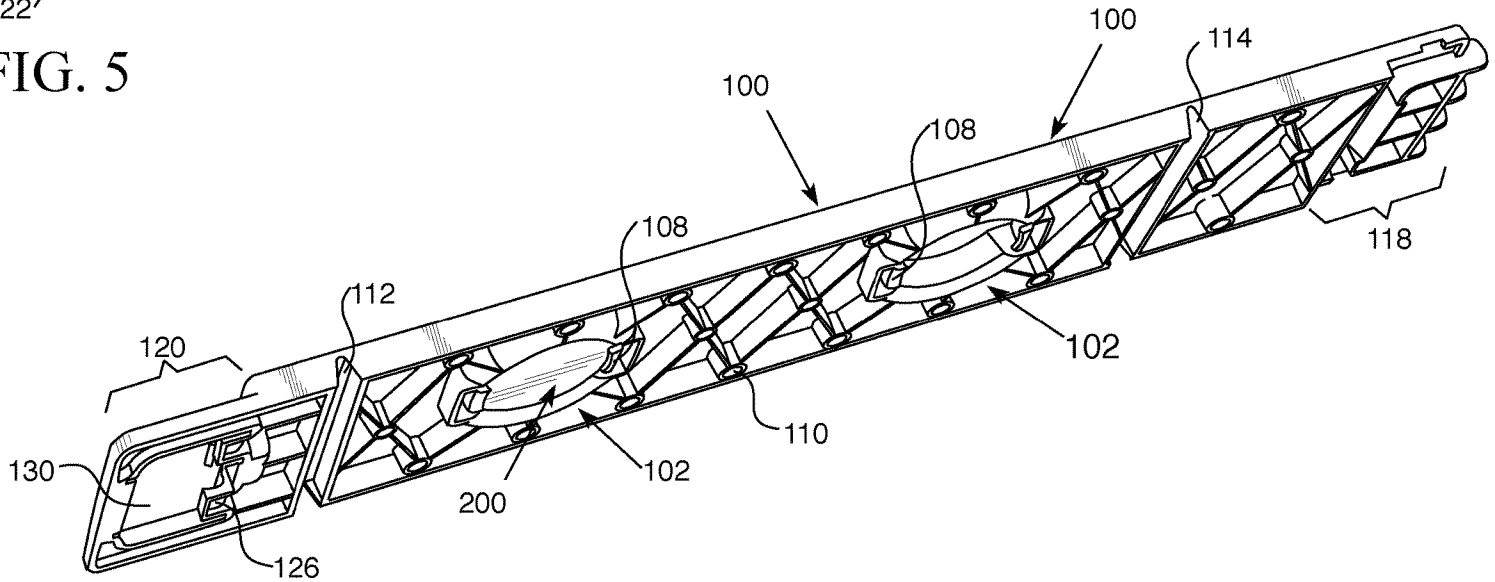
FIG. 6 is an isometric top view of the modular panel mount strip.

In some embodiments, elongate body 100 may include two segmentation grooves near opposing ends of the elongate body, as illustrated in FIGS. 5-6. However, other variations are envisioned. For example, the elongate body may have multiple segmentation grooves near the same end, one segmentation groove near one end, multiple segmentation grooves near each of the opposing ends, or combinations thereof. As illustrated in FIGS. 5-6, a first segmentation groove may be short-end segmentation groove 112 and a second segmentation groove may be long-end segmentation groove 114. In some cases, short-end segmentation groove 112 may be closer to one end of elongate body 100 than long-end segmentation groove 114 is from the opposing end and, therefore, segmentation of the elongate body along the short-end segmentation groove 112 results in removal of less of the elongate body than segmentation of the elongate body along the long-end segmentation groove. Therefore, the final length of elongate body 100 when short-end segmentation groove 112 is severed is longer than the final length of the elongate body when long-end segmentation groove 114 is severed. However, this is not necessarily required, and the first segmentation groove may in fact be the same distance from one end of the elongate body as the second segmentation groove is from the opposing end.

In some cases, each segmentation groove may run from the top edge of the elongate body to the bottom edge of the elongate body. More specifically, each segmentation groove may be a channel on the back face of elongate body 100, such that the majority of solid material of the elongate body along this channel is removed or carved out, leaving a thin layer of material between the channel and the front face, as illustrated in FIG. 6. This channel may run the entirety of the length of back face, as illustrated in the Figures. However, the channel may alternatively be interspersed along a line (i.e., the channel may be comprised of several short channels that are in line with each other, thereby creating a "dashed" or "broken line" look) or the channel may be centered between the top and bottom of the elongate body with the peripheral edges of the segmentation groove being solid instead of a carved-out channel. It is envisioned that each segmentation groove may be easily broken by hand without breaking other parts of the elongate body. Alternatively, each segmentation groove may be cut with a tool or, in cases where the elongate body is made of a softer material, the end of the elongate body may be torn away along the segmentation groove.

In addition to using segmentation grooves to alter the length of elongate body 100, the modular panel mount strip may include interlocking mechanism 116, as briefly mentioned above. Interlocking mechanism 116 may include interlocking features such as hinged portion 118 and locking portion 120. More specifically, a hinged portion on one modular panel mount strip can interconnect with a locking portion on a second modular panel mount strip to create a modular device that is twice as long, as illustrated in FIGS. 9-10, and that can, therefore, offer additional support to a panel, as described above, or piece of art due to the increased number of magnet housings available to retain magnets. In some cases, each modular panel mount strip may include a hinged portion and a locking portion on opposing ends from each other, as illustrated in FIGS. 1-8. In other cases, each modular panel mount strip may only include one of the hinged portion and locking portion on an end with neither interlocking feature on the opposing end.

Hinged portion 118 can, in some embodiments, be located on a first end, and that first end may further include long-end segmentation groove 114, as illustrated in FIGS. 2-3. However, the hinged portion may also be located on the same end as short-end segmentation groove 112. Hinged portion 118 may include hinge 122 and slot 124, wherein the hinge is along an outer edge and includes grips or ridges that are spaced apart from each other, and the slot is encompassed within elongate body 100 such that it is an aperture through the front and back faces. Hinge 122 and slot 124 may be located closer to the end of hinged portion 100 than any mounting points 110. Additionally, the thickness of hinged portion 118 may be half the thickness of elongate body 100. More specifically, the top face of hinged portion 118 may be in the same plane as the front face of elongate body 100, while the back face of hinged portion 118 may not be on the same plane as the back face of elongate body 100.

Locking portion 120 can, in some embodiments, be located on a second end, and that second end may further include short-end segmentation groove 112, as illustrated in FIGS. 4 and 7. However, the locking portion may also be located on the same end of long-end segmentation groove 114. Locking portion 120 may include hinge tabs 126, slot tab 128, and gap 130. Gap 130 may be a through-hole defined by outer top, bottom, and end edges of elongate body 100 as well as an interior edge of the elongate body, as illustrated in FIG. 1. Hinge tabs 126 may be located along the interior edge of elongate body 100, such that the hinge tabs protrude into gap 130. Slot tab 128 may be located along an interior edge of the end edge of elongate body 100, such that the slot tab protrudes into gap 130. Both hinge tabs 126 and slot tab 128 may have hooks on their ends to engage corresponding components on hinged portion 118, as described further below. Similar to hinge portion 118, locking portion 120 may be half the thickness of elongate body 100. More specifically, the back face of locking portion 120 may be in the same plane as the back face of elongate body 100, while the front face of locking portion 120 may not be in the same plane as the front face of elongate body 100.

To interlock hinged portion 118 and locking portion 120, hinge tabs 126 may be structured and configured to accept hinge 122 and slot 124 may be structured and configured to accept slot tab 128. For example, hinge 122 may include three spaced-apart grips or ridges and hinge tabs 126 may provide three alternating tabs, such that a first tab faces upward, a second middle tab faces downward, and a third tab faces upward. The distance between the top portion of the second middle tab and the bottom portions of the first and third tabs may be roughly equivalent to, or slightly small then, the thickness of the hinge. This enables hinge 122 to securely fit between hinge tabs 126 and for the hinge tabs to put enough force onto the hinge such that the hinge tabs firmly hold the hinge in place.

Slot tab 128 may be an upwardly protruding tab that is structured and configured to fit within slot 124, such that the combined connection of the slot tab in the slot and of the hinge in the hinge tabs creates a secure locking mechanism. In some embodiments, slot 124 may have a ledge, as illustrated in FIGS. 1 and 7, upon which a top hook of slot tab 128, illustrated in FIGS. 3, 5, and 7, can secure when the two components are combined. As mentioned above, gap 130 may be an aperture located between hinge tabs 126 and slot tab 128 that provides space for additional components of hinged portion 118 to fit once the hinged portion and locking portion 120 are interlocked. In some embodiments, hinge tabs 126 and/or slot tab 128 may protrude into gap 130.

As mentioned above, while modular panel mount strip may include hinged portion 118 and locking portion 120, it is envisioned that the two interlocking features on a single modular panel mount strip do not interact with each other, but with additional modular panel mount strips so as to increase the overall length of the modular, wall-mounted support system.

Persons of ordinary skill in arts relevant to this disclosure and subject matter hereof will recognize that embodiments may comprise fewer features than illustrated in any individual embodiment described by example or otherwise contemplated herein. Embodiments described herein are not meant to be an exhaustive presentation of ways in which various features may be combined and/or arranged. Accordingly, the embodiments are not mutually exclusive combinations of features; rather, embodiments can comprise a combination of different individual features selected from different individual embodiments, as understood by persons of ordinary skill in the relevant arts. Moreover, elements described with respect to one embodiment can be implemented in other embodiments even when not described in such embodiments unless otherwise noted. Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended. Furthermore, it is intended also to include features of a claim in any other independent claim even if this claim is not directly made dependent to the independent claim.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims, it is expressly intended that the provisions of Section 112, sixth paragraph of 35 U.S.C. are not to be invoked unless the specific terms "means for" or "step for" are recited in a claim.

What is claimed is:

1. A modular panel mount strip comprising:

an elongate body having a front face, a back face, a top edge, a bottom edge, and a magnet housing;

a magnet retained within the magnet housing;

an interlocking feature on a first end of the modular panel mount strip and a second interlocking feature on a second end of the modular panel mount strip opposite the first end; and a segmentation groove extending, parallel to at least one of the first end or the second end of the modular panel mount strip and between the interlocking feature and the magnet housing, from the top edge to the bottom edge of the elongate body;

wherein the interlocking feature includes a locking portion comprised of a plurality of hinge tabs and a slot tab, wherein the second interlocking feature includes a hinge portion comprised of a hinge pin and an interior slot, wherein the hinge pin is along an outer edge of the modular panel mount strip and wherein the interlocking feature and the second interlocking feature allows attachment to additional modular panel mount strips.

2. The modular panel mount strip of claim 1, further comprising a second segmentation groove between the top edge and the bottom edge of the elongate body.

3. The modular panel mount strip of claim 2, wherein the segmentation groove and the second segmentation groove are located on either side of the magnet housing and are elongate channels on the back face of the elongate body, each channel comprising a thin layer of material between the entirety of the respective channel and the front face.

4. The modular panel mount strip of claim 1, further comprising a second magnet housing.

5. The modular panel mount strip of claim 4, further comprising a second magnet retained within the second magnet housing.

6. The modular panel mount strip of claim 1, wherein the magnet housing is comprised of:

an aperture defined by an annular, sloped housing wall; and at least two retention tabs on opposing ends of the housing wall.

7. The modular panel mount strip of claim 6, wherein the magnet:

is shaped to fit within the magnet housing;

has sloped sides that correspond to the annular, sloped housing wall of the magnet housing; and is retained within the magnet housing by the at least two retention tabs.

8. The modular panel mount strip of claim 1, in combination with a second modular panel mount strip having an interlocking feature on an end of the second modular panel mount strip, wherein:

the interlocking feature on the first end of the modular panel mount strip is structured and configured to interlock with the interlocking feature on the second modular panel mount strip.

9. The modular panel mount strip of claim 8, wherein:

the interlocking feature of the second modular panel mount is comprised of a hinge portion; and the hinge portion on the second modular panel mount strip is comprised of:

a hinge pin along an outer edge of the second modular panel mount strip, and an interior slot.

10. The modular panel mount strip of claim 9, further comprising a second segmentation groove between the top edge and the bottom edge of the elongate body, wherein the second segmentation groove is located between the magnet housing and the second end of the modular panel mount strip.

11. The modular panel mount strip of claim 1, in combination with a second modular panel mount strip having a locking portion on one end, the locking portion being comprised of hinge tabs and a slot tab, wherein:

the second interlocking feature of the modular panel mount strip is configured to connect with the second modular panel mount strip, wherein the hinge tabs of the locking portion of the second modular panel mount strip are configured to receive the hinge pin of the modular panel mount strip, and the interior slot of the hinge portion on the modular panel mount strip is configured to receive the slot tab of the locking portion of the second modular panel mount strip.

12. The modular panel mount strip of claim 11, further comprising a second segmentation groove between the top edge and the bottom edge of the elongate body, wherein:

the segmentation groove is located between the magnet housing and the locking portion; and the second segmentation groove is located between the magnet housing and the second end of the modular panel mount strip.

13. A modular panel mount strip comprising:

an elongate body having a front face, a back face, a top edge, a bottom edge, and a plurality of magnet housings;

a plurality of magnets, wherein each magnet is respectively retained within each of the plurality of magnet housings;

a segmentation groove between the top edge and the bottom edge of the elongate body; and an interlocking mechanism comprising:

a hinge portion on a first end of the elongate body, the hinge portion being comprised of a hinge pin and an interior slot, and a locking portion on a second, opposite end of the elongate body, the locking portion being comprised of a plurality of hinge tabs and a slot tab;

wherein the segmentation groove is located between one of the first or the second ends of the elongate body and at least one of the plurality of magnet housings, and wherein the interlocking mechanism allows attachment to additional modular panel mount strips.

14. The modular panel mount strip of claim 13, further comprising a second segmentation groove between the top edge and the bottom edge of the elongate body, wherein the second segmentation groove is located between the other of the first or the second ends of the elongate body and the at least one of the plurality of magnet housings so that the at least one of the plurality of magnet housings are positioned between the segmentation groove and the second segmentation groove.

15. The modular panel mount strip of claim 13, wherein each of the plurality of magnet housings are comprised of:

an aperture defined by an annular, sloped housing wall; and at least two retention tabs on opposing ends of the housing wall.

16. The modular panel mount strip of claim 15, wherein each of the magnets:

has sloped sides that correspond to the sloped housing walls of the plurality of magnet housings; and is retained within a respective one of the plurality of magnet housings by the at least two retention tabs.

17. The modular panel mount strip of claim 13, wherein the elongate body is further comprised of a plurality of mounting points.

18. The modular panel mount strip of claim 17, wherein:

the mounting points are through-holes;

the plurality of mounting points are positioned in two rows along a length of the elongate body;

a first of the two rows is along a top portion of the front and back face; and a second of the two rows is along a bottom portion of the front and back face.

19. The modular panel mount strip of claim 13, wherein:

the segmentation groove is an elongate channel in the back face comprising a thin layer of material between the entire channel and the front face, and a thickness of the segmentation groove is less than a thickness of a remainder of the elongate body.

* * * * *